US009649687B2

(12) United States Patent
Wagner et al.

(10) Patent No.: US 9,649,687 B2
(45) Date of Patent: May 16, 2017

(54) METHOD INCLUDING FIBER REINFORCED CASTING ARTICLE

(71) Applicant: UNITED TECHNOLOGIES CORPORATION, Hartford, CT (US)

(72) Inventors: Joel H. Wagner, Wethersfield, CT (US); John R. Farris, Bolton, CT (US); John Joseph Marcin, Malborough, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 0 days.

(21) Appl. No.: 14/744,450

(22) Filed: Jun. 19, 2015

(65) Prior Publication Data

US 2015/0367412 A1 Dec. 24, 2015

Related U.S. Application Data

(60) Provisional application No. 62/015,003, filed on Jun. 20, 2014.

(51) Int. Cl.
*B22D 29/00* (2006.01)
*B22C 9/10* (2006.01)

(52) U.S. Cl.
CPC ..... *B22D 29/001* (2013.01); *B22C 9/106* (2013.01); *B22D 29/002* (2013.01)

(58) Field of Classification Search
CPC ..... B22D 29/001–29/002; B22C 9/10; B22C 9/106
See application file for complete search history.

(56) References Cited

U.S. PATENT DOCUMENTS 3,166,808 A * 1/1965 Moore ..... B22C 9/106 106/38.51
4,427,742 A * 1/1984 Willgoose ..... B22C 9/04 204/281
4,989,664 A 2/1991 Roth
5,126,082 A 6/1992 Frank
5,273,104 A 12/1993 Renaud et al.
5,649,585 A 7/1997 Nolte et al.
(Continued)

FOREIGN PATENT DOCUMENTS

EP 0539317 11/1996
JP 62296932 A * 12/1987
(Continued)

OTHER PUBLICATIONS

Pergamon; Progress in Materials Science 46 (2001) 559-632; "Manufacture, characterisation and application of cellular metals and metal foams"; Banhart, John. Accepted Jan. 1, 2000.

*Primary Examiner* — Kevin E Yoon
*Assistant Examiner* — Jacky Yuen
(74) *Attorney, Agent, or Firm* — Carlson, Gaskey & Olds P.C.

(57) ABSTRACT

A method of forming an engine component according to an exemplary aspect of the present disclosure includes, among other things, introducing molten metal into a cavity between a shell and a casting article in the shell. The casting article includes a ceramic portion and a plurality of fibers. The method further includes separately removing the ceramic portion and the fibers from an interior of the component.

3 Claims, 3 Drawing Sheets

(56) References Cited

U.S. PATENT DOCUMENTS

| | | | | |
|---|---|---|---|---|
| 5,947,181 | A * | 9/1999 | Davis | B22C 9/106 164/131 |
| 6,029,736 | A * | 2/2000 | Naik | B22C 9/106 164/132 |
| 6,450,243 | B1 | 9/2002 | Shaw et al. | |
| 6,474,348 | B1 * | 11/2002 | Beggs | B22D 29/006 134/22.1 |
| 6,755,237 | B2 | 6/2004 | Duffey et al. | |
| 6,769,475 | B2 | 8/2004 | Shaw et al. | |
| 2003/0192667 | A2 | 10/2003 | Shaw et al. | |
| 2007/0095501 | A1 * | 5/2007 | Beals | B22D 29/002 164/519 |
| 2012/0222961 | A1 * | 9/2012 | Smallwood | B22D 29/002 205/187 |
| 2015/0083356 | A1 * | 3/2015 | Longa | B22C 7/06 164/15 |

FOREIGN PATENT DOCUMENTS

| | | | | |
|---|---|---|---|---|
| WO | 0145876 | | 6/2001 | |
| WO | WO 2013156713 | A2 * | 10/2013 | B22C 7/06 |

* cited by examiner

METHOD INCLUDING FIBER REINFORCED CASTING ARTICLE

BACKGROUND

Gas turbine engines include various components, such as blades, vanes, and blade outer air seals (BOASs), that are exposed to relatively hot gases during operation of the engine. These components often include internal passageways for routing a flow of cooling fluid within the component.

Components having relatively complex internal passageways are manufactured using a number of techniques. One example technique is investment casting. In this technique, casting articles are used to form internal passageways. In particular, molten metal is poured around the casting articles, and, after the metal is allowed to cool, the casting articles are removed from the interior of the components using a leaching technique, for example.

SUMMARY

A method of forming an engine component according to an exemplary aspect of the present disclosure includes, among other things, introducing molten metal into a cavity between a shell and a casting article in the shell. The casting article includes a ceramic portion and a plurality of fibers. The method further includes separately removing the ceramic portion and the fibers from an interior of the component.

In a further non-limiting embodiment, the foregoing method includes cooling the molten metal, and the plurality of fibers and the ceramic portion are removed after the molten metal cools.

In a further non-limiting embodiment of the foregoing method, the ceramic portion is removed from the component using a first leaching fluid, and the fibers are removed from the component using a second leaching fluid different in chemical composition than the first leaching fluid.

In a further non-limiting embodiment of the foregoing method, the ceramic portion is removed from the component using a leaching fluid, and the fibers are mechanically removed from the component.

In a further non-limiting embodiment of the foregoing method, the fibers are blown out of the component using a pressurized fluid.

In a further non-limiting embodiment of the foregoing method, the pressurized fluid is pressurized air.

In a further non-limiting embodiment of the foregoing method, a maximum length of the fibers is less than a smallest orifice formed in the engine component.

In a further non-limiting embodiment of the foregoing method, the fibers dissolve during the introducing step.

In a further non-limiting embodiment of the foregoing method, the fibers fully dissolve during the introducing step.

In a further non-limiting embodiment of the foregoing method, after the molten metal cools, the remainder of the casting article is removed from the component using a leaching fluid.

In a further non-limiting embodiment of the foregoing method, the size and chemical composition of the fibers is selected such that the fibers will intentionally dissolve during the introducing step.

In a further non-limiting embodiment of the foregoing method, the fibers are randomly oriented within the ceramic portion.

In a further non-limiting embodiment of the foregoing method, the ceramic portion includes alumina ($Al_2O_3$).

In a further non-limiting embodiment of the foregoing method, the fibers are provided by one of (1) silicon (Si) fibers, (2) carbon (C) fibers, and (3) metal fibers.

A method of forming an engine component according to another exemplary aspect of this disclosure includes, among other things, introducing molten metal into a cavity between a shell and a casting article. The casting article includes a ceramic portion and a plurality of fibers. The method further includes dissolving the fibers during the introducing step, and removing the remainder of the casting article from the interior of the component using a leaching fluid.

In a further non-limiting embodiment of the foregoing method, the size and material of the fibers is selected such that the fibers will intentionally dissolve during the introducing step.

In a further non-limiting embodiment of the foregoing method, the fibers completely dissolve during the introducing step.

In a further non-limiting embodiment of the foregoing method, the ceramic portion includes alumina ($Al_2O_3$).

In a further non-limiting embodiment of the foregoing method, the fibers are provided by one of (1) silicon (Si) fibers, (2) carbon (C) fibers, and (3) metal fibers.

A method of forming an engine component according to yet another exemplary aspect of this disclosure includes, among other things, providing a ceramic shell and a casting article. The casting article includes a ceramic portion and a plurality of fibers. The method further includes sintering the ceramic shell and the casting article, wherein the plurality of fibers are dissolved by the sintering step, introducing a molten metal between the shell and the casting article, and removing the remainder of the casting article from the interior of the component.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE DRAWINGS

The drawings can be briefly described as follows.

DETAILED DESCRIPTION

Figure 1:
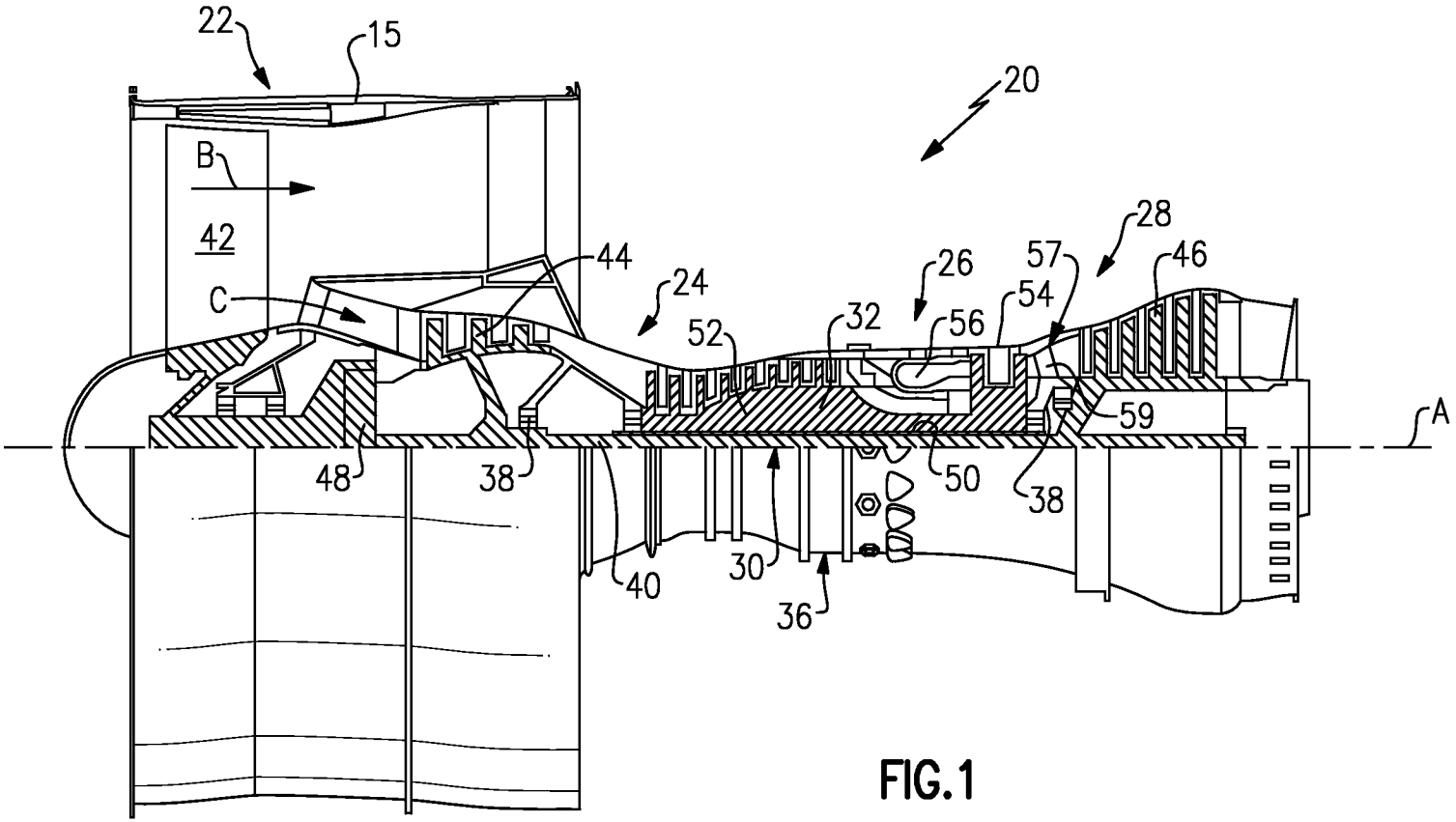
FIG. 1 schematically illustrates an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core airflow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

Figure 2:
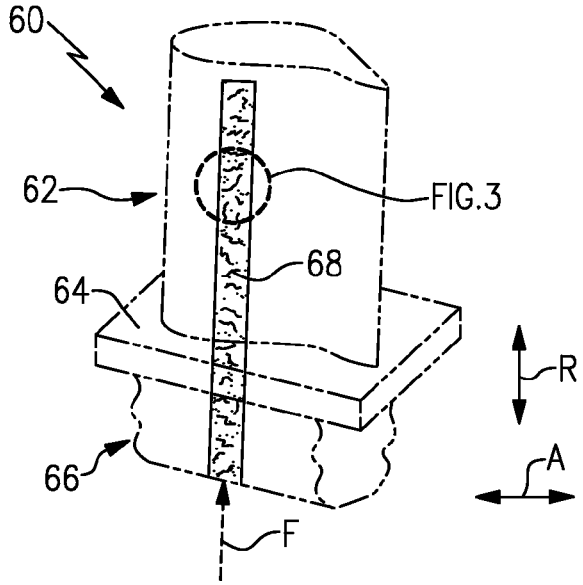
FIG. 2 illustrates an example engine component in phantom, and further illustrates an example casting article.

FIG. 2 illustrates an example engine component 60 in phantom. In this example, the engine component 60 is a blade, such as a blade for use within the turbine section 28 of the engine 20. It should be understood that this disclosure extends to other engine components, including vanes and blade outer air seals (BOASs), as examples. It should be understood that this disclosure is not limited to components in the turbine section 28, and extends to other sections of the engine 20.

The component 60 includes an airfoil section 62, a platform 64, and a root section 66. An example casting article, or core, is illustrated at 68. The casting article 68 is used during an investment casting process to form an internal passageway within the component 60. The shape of the casting article 68 is a negative of the intended shape of the internal passageway. In this respect, the casting article 68 may be shaped differently than the specific casting article 68 illustrated in FIG. 2. Further, while only one casting article 68 is illustrated, additional casting articles may be used to provide the component 60 with the intended internal passageway configuration. In particular, the component 60 may include internal passageways that direct fluid to an exterior surface of the component 60 for film cooling.

Figure 3:
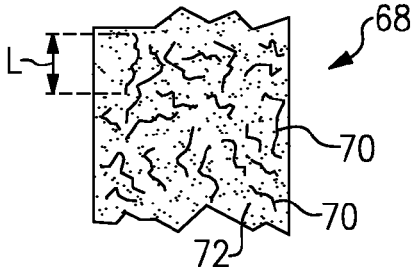
FIG. 3 is a close-up of the encircled area in FIG. 2.

FIG. 3 illustrates the detail of the casting article 68. In this example, the casting article 68 includes a plurality of fibers 70 incorporated into a ceramic material 72. The fibers 70 may be randomly oriented within the ceramic portion 72 or introduced in an ordered structure. The fibers 70 increase the strength of the casting article 68.

Figure 4:
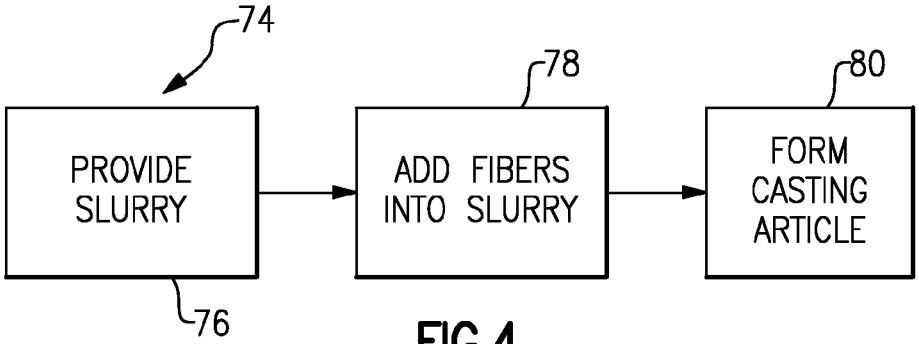
FIG. 4 is a flow chart representing an example method for forming a casting article.

FIG. 4 illustrates an example method 74 of forming the casting article 68. At 76, a slurry (or mix) of ceramic material is provided. The slurry may include a carrier fluid or media and ceramic particles. The carrier fluid can be any known type of carrier fluid, such as a solvent, water, alcohol, or solid or semi-solid media such as wax. The ceramic particles may be provided by any known type of ceramic material, including but not limited to alumina ($Al_2O_3$), silica ($SiO_2$), aluminosilicate ($Al_2SiO_4$), and zircon ($ZrAl_2O_4$). The slurry may also contain smaller quantities of the elemental oxides for modification of specific properties. The slurry provided at 76 will ultimately form the ceramic portion 72 of the casting article 68. At 78, the fibers 70 are added into the slurry. The fibers may be silicon (Si) fibers, alumina ($Al_2O_3$), organic fibers such as carbon (C) fibers, or metal fibers, to name a few examples. The volumetric ratio of the fibers to slurry might range from 1% to 50%, depending on casting requirements. In this embodiment, the fibers may be relatively evenly dispersed, randomly dispersed, or may be preferentially dispersed within the casting article. Fibers may take various shapes and sizes from nanoparticle to microfibers that extend through the components. The fibers may be random or oriented to maximize physical properties in a desired direction. At 80, the slurry, which now includes the fibers 78, is introduced into a die, and the casting article 68 is formed.

Figure 5:
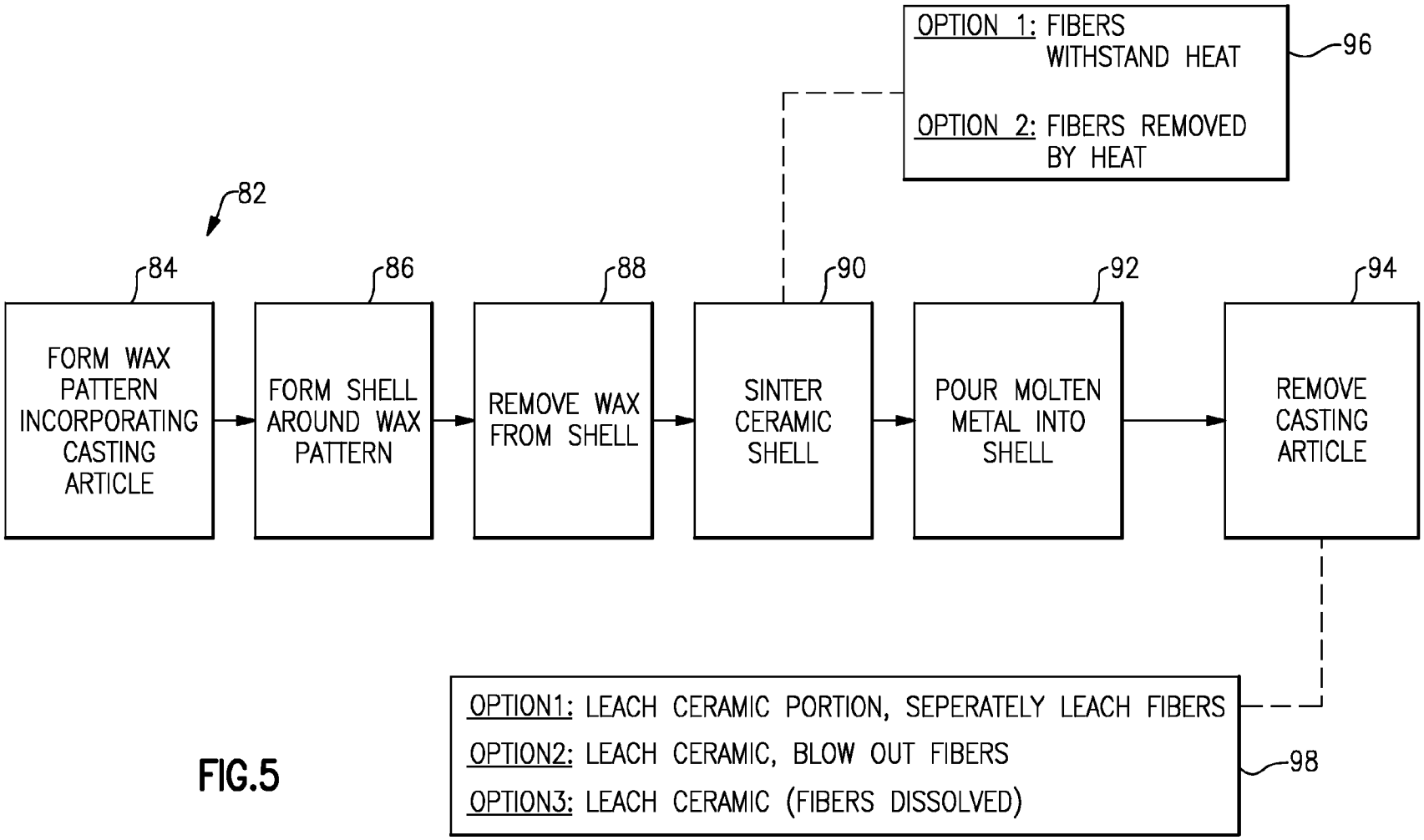
FIG. 5 is a flow chart representing an example method for forming an engine component.

FIG. 5 illustrates an example method 82 for forming an engine component having an internal passageway. The method 82 is an investment casting technique. At 84, a wax pattern of the engine component, which includes the casting article 68, is provided. At 86, a ceramic shell is formed around the wax pattern and the casting article 68. At 88, wax is removed from the ceramic shell leaving a hollow cavity in the ceramic shell containing the integral ceramic casting article. At 90, the ceramic shell is heated to sinter the ceramic. At 92, molten metal is introduced (e.g., poured) into the ceramic shell, at 88, and replaces the place of the wax pattern. The molten metal is allowed to cool, and the casting article 68 is removed at 94.

Without the fibers 70, the casting article 68 may not withstand the thermal stresses from the molten metal. The fibers 70 reinforce the casting article 68, and increase the overall mechanical properties of the casting article 68.

The size (including the length L and thickness) of the fibers 68, as well as the chemical composition of the fibers, may be adjusted such that the fibers either survive the ceramic shell sintering at step 92 ("option 1" at 96), or are removed (e.g., dissolved) by heat ("option 2" at 96). In this example, fibers comprised of, for example, silicon would likely remain post-pour and fibers comprised of, for example, carbon would likely be consumed during the pour and cooling process. In the example where the fibers 68 do not dissolve during sintering, the fibers 70 survive long enough to keep the casting article 68 intact during the hot pour of molten metal. Further, by dissolving the fibers, the ease of removing the casting article at 94 increases.

At 94, the casting article 68 may be removed chemically or thermally from out of the component 60. At least the ceramic portion 72 of the casting article 68 is leachable using a known leaching fluid (e.g., Sodium Hydroxide). The fibers 70, depending on their material, may also be leachable. In one example, the fibers 70 are leached using a different fluid (e.g., a fluid having a different chemical composition) than the fluid used to leach the ceramic portion 72 ("option 1" at 98).

In another example, the ceramic portion 72 is leachable, but the fibers 70 are not. In that example, the fibers 70 may be mechanically removed from the component 60. In one example, mechanical removal includes blowing out (i.e., purging) the fibers 70 using a pressurized fluid that carries the fibers out of the internal passageway, such as pressurized air ("option 2" at 98). In this example, it may be important to ensure that the length L of the fibers 70 is substantially small. In particular, in one example, the maximum allowable length L of the fibers 70 is less than the smallest orifice formed in the component 60. Finally, in the example where the fibers 70 dissolve during step 90, the ceramic portion 72 can be leached and no further removal of fibers is required ("option 3" at 98).

This disclosure provides a casting article having increased structural integrity, which leads to higher quality components. Further, the disclosed techniques increase the reliability and repeatability of the process for removing the casting article 68 from the interior of the component. This reduces cleaning time and streamlines manufacturing overall.

It should be understood that terms such as "axial" and "radial" are used above with reference to the normal operational attitude of the engine 20. Further, these terms have been used herein for purposes of explanation, and should not be considered otherwise limiting. Terms such as "generally," "substantially," and "about" are not intended to be boundaryless terms, and should be interpreted consistent with the way one skilled in the art would interpret the term.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A method of forming an engine component, comprising:

introducing molten metal into a cavity between a shell and a casting article in the shell, the casting article including a ceramic portion and a plurality of fibers, wherein the fibers are randomly oriented within the ceramic portion, and wherein the fibers are formed by one of (1) silicon (Si) fibers, (2) carbon (C) fibers, and (3) metal fibers; and separately removing the ceramic portion and the fibers from an interior of the component, wherein the ceramic portion is removed from the component using a first leaching fluid, and the fibers are removed from the component using a second leaching fluid different in chemical composition than the first leaching fluid.

2. The method as recited in claim 1, further comprising:

cooling the molten metal, wherein the plurality of fibers and the ceramic portion are removed after the molten metal cools.

3. The method as recited in claim 1, wherein the ceramic portion includes alumina ($Al_2O_3$).

* * * * *